US006351919B1

(12) United States Patent
Lin et al.

(10) Patent No.: US 6,351,919 B1
(45) Date of Patent: Mar. 5, 2002

(54) COMPRESSION RELIEF SECTION

(75) Inventors: Yu Lin, Blue Bell; Daniel C. Ziegler, Millersville; William J. Platt, Aston, all of PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 09/610,071

(22) Filed: Jul. 1, 2000

(51) Int. Cl.[7] ..... E04B 9/06

(52) U.S. Cl. ..... 52/506.07; 52/506.06; 52/506.08; 52/220.6

(58) Field of Search ..... 52/506.06, 506.08, 52/506.07, 733.1, 573.1, 220.6

(56) References Cited

U.S. PATENT DOCUMENTS

| | | | | |
|---|---|---|---|---|
| 3,175,655 | A | 3/1965 | Brown et al. | |
| 3,189,139 | A | 6/1965 | Znamirowski et al. | |
| 3,193,063 | A | 7/1965 | Brown et al. | |
| 3,367,695 | A | 2/1968 | Haertel et al. | |
| 3,388,519 | A | 6/1968 | Downing, Jr. | |
| 3,397,501 | A | 8/1968 | Jahn | |
| 3,496,690 | A | 2/1970 | Jahn | |
| 3,501,185 | A | 3/1970 | Brown et al. | |
| 3,589,089 | A * | 6/1971 | Kedel | 52/495 |
| 3,746,379 | A | 7/1973 | Sauer | |
| 3,778,947 | A | 12/1973 | Sauer | |
| 3,846,031 | A | 11/1974 | Adams | |
| 3,965,631 | A | 6/1976 | Sauer | |
| 4,016,701 | A | 4/1977 | Beynon | |
| 4,106,878 | A | 8/1978 | Jones | |
| 4,128,978 | A | 12/1978 | Beynon | |
| 4,161,856 | A | 7/1979 | Brown et al. | |
| 4,598,514 | A | 7/1986 | Shirey | |
| 4,601,153 | A | 7/1986 | Dunn et al. | |
| 4,606,166 | A | 8/1986 | Platt et al. | |
| 4,713,919 | A | 12/1987 | Platt | |
| 4,785,595 | A | 11/1988 | Dunn | |
| 4,893,444 | A | 1/1990 | Ollinger et al. | |
| 5,313,750 | A | 5/1994 | Frecska et al. | |
| 5,347,783 | A | 9/1994 | Frecska et al. | |
| 5,349,803 | A | 9/1994 | Nute, Jr. | |
| 5,363,622 | A | 11/1994 | Sauer | |
| 5,839,246 | A | 11/1998 | Ziegler et al. | |

* cited by examiner

*Primary Examiner*—Carl D. Friedman
*Assistant Examiner*—Jennifer I. Thissell
(74) *Attorney, Agent, or Firm*—Eugene Chovanes

(57) ABSTRACT

A compression relief section in a beam in a grid for a suspended ceiling that permits controlled collapse of the section during a fire, whereby the ceiling is kept relatively intact. The section has a channel formed from the web portion of the beam, and a crushed bulb with a hump, along with a flange, that fold from compression forces, while resisting such forces. There is no interference between the folding portions and the ceiling panels, or drywall, when the section collapses.

2 Claims, 8 Drawing Sheets

COMPRESSION RELIEF SECTION

BACKGROUND OF THE INVENTION

1. Field of the Invention

This invention relates to a grid that supports panels and ceiling fixtures in a suspended ceiling.

More particularly, the invention provides a compression relief section for controlled contraction of a main beam in the grid in the event of a fire.

2. Background Information

Grid beams in a suspended ceiling, under normal conditions, are subject only to vertical loads from panel and accessories. Hanger wires, anchored to the structural ceiling above the suspended ceiling, generally located 4' apart on the main beams, provide support for such horizontal main beams. Cross beams are supported from the main beams. Both beams support panels. The beams are of an inverted T cross-section, and are formed by roll forming light sheet metal strip.

Under normal conditions, the beams are subject to primarily vertical loads. In the event of fire, however, the beams in the grid are subject to compressive forces in the manner of a column that supports a vertical load, although the load is applied horizontally at the ends of the beam. Under heat, the beam seeks to expand longitudinally, and since the ends are constrained at the walls of the room, the beams buckle, unless the build up of compression forces is relieved.

If the beams buckle, the panels are no longer supported in position, leaving the structural ceiling above the suspended ceiling exposed to the high heat of the fire. With the fire resistant panels in place, the structural ceiling is protected against the fire.

A prior art way of keeping the beams, which act as a horizontal column under a compressive load during a fire, relatively intact, is to provide in the beam relief joints that permit the beam to collapse longitudinally, while keeping the beam relatively straight. Such joints are shown, for instance, in U.S. Pat. Nos. 4,606,166 and 5,349,803, incorporated herein by reference.

SUMMARY OF THE INVENTION

The compression relief section of the invention has a notched channel in the web and a crushed and notched bulb. The section collapses and the beam contracts when the compression forces from a fire build-up in the beam. The section collapses in the manner wherein the channel, bulb, and flange of the beam fold in such a manner that the beam is kept longitudinally aligned, to provide support for the panels.

DESCRIPTION OF THE PREFERRED EMBODIMENT

Figure 1:
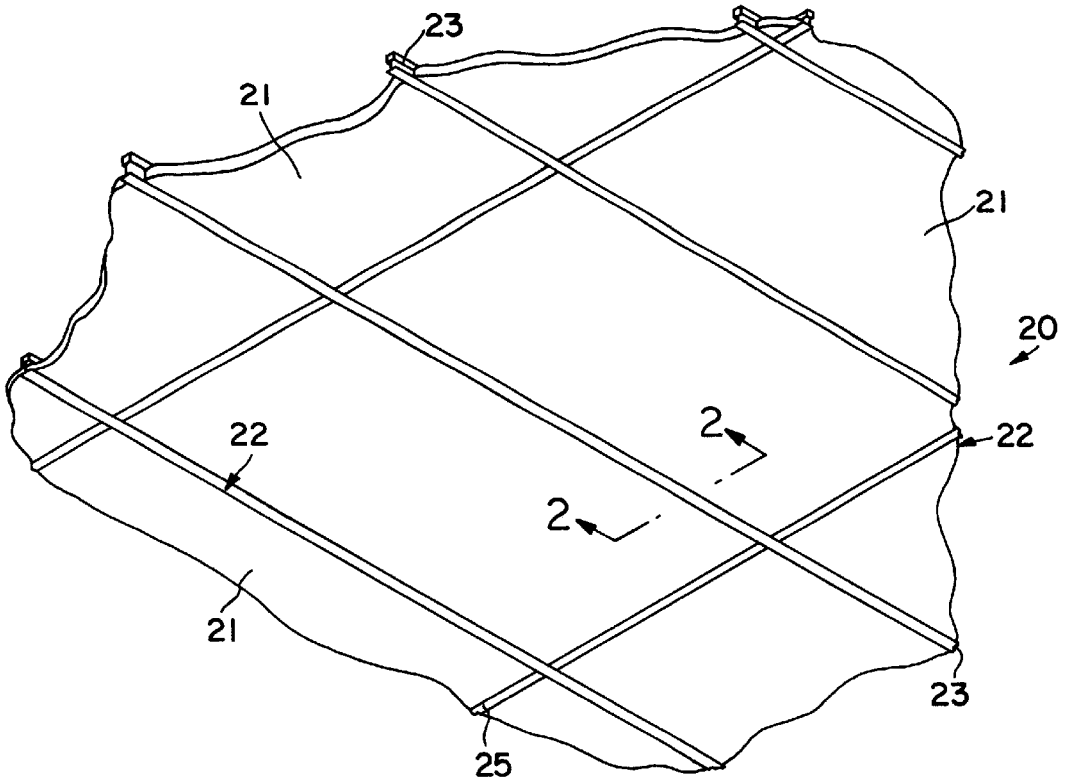
FIG. 1 is a perspective view of a suspended ceiling having panels supported on a grid of beams.

As seen in FIG. 1, suspended ceiling 20 has panels 21 supported by a rectangular ceiling grid 22. Grid 22 has main beam 23 and cross beams 25. Main beams 23, generally 12' lengths connected together in abutting relationship, are suitably supported at, for instance, 4 foot intervals by hanger wires anchored in the structural ceiling and connected to the main beams through holes in the web of the beam. The cross beams are supported from the main beams.

The beams are formed of a strip of sheet metal rolled into a cross-sectional shape having a bulb 26, a web 27 of the two layers 28 and 29, and a flange 31 having opposing sides 32 and 33. A bottom cap 35 extends over the flange sides and is secured to the flange at its edges at 36 and 37. Suitable stitching 38 may extend through the layers of the web to strengthen the web.

Such beam construction is well known in the prior art.

The compression relief section 40 of the invention has a cut-out 41 in the web 27, a channel 42 in the web that collapses in a controlled manner under compressive forces in the beam, a cut-out 43 in the bulb, and a bulb shape 44.

Figure 5:
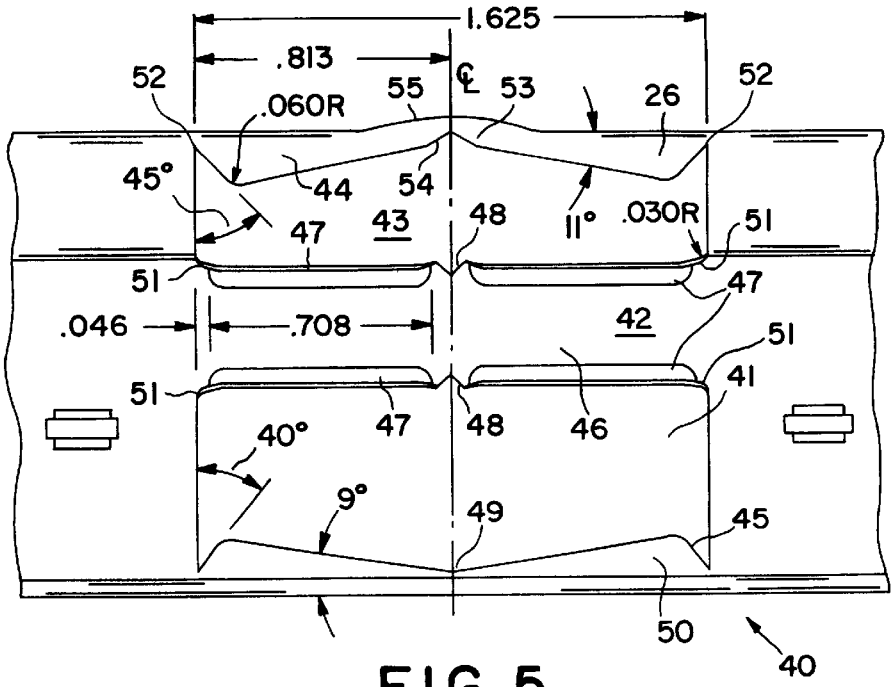
FIG. 5 is a side elevation of the compression relief section shown in FIG. 3.

Cut-out 41 is desirably of the dimensions shown in FIG. 5, in inches. It should be understood, however, that such dimensions are merely illustrative for purposes of understanding the invention, the scope of which is set forth in the claims.

Figure 10:
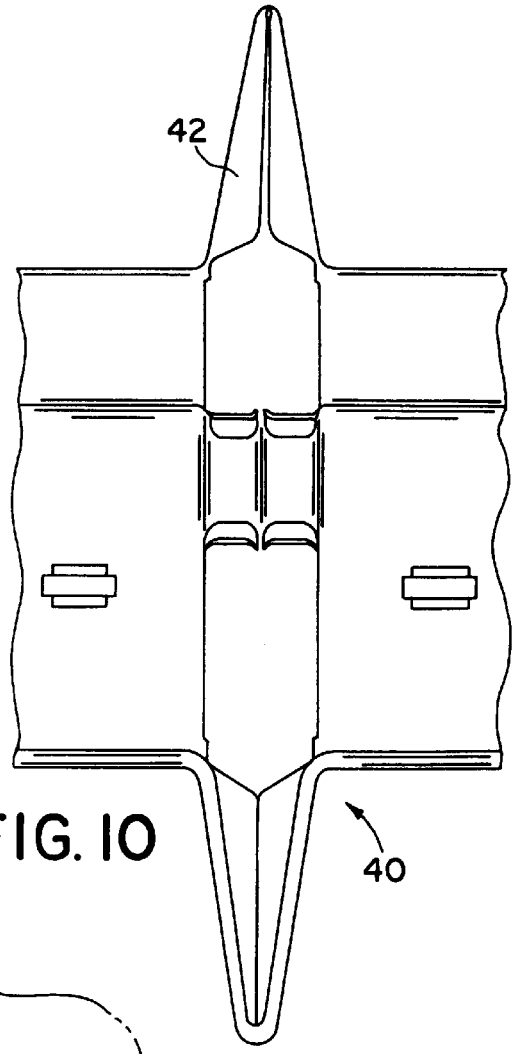
FIG. 10 is a side elevation showing the section fully collapsed.
Figure 11:
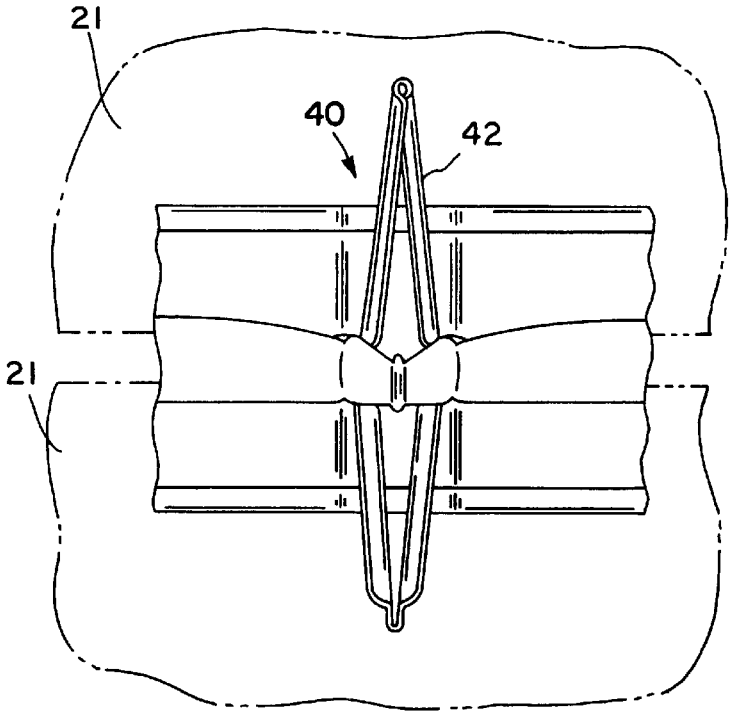
FIG. 11 is a top plan view showing the section fully collapsed.
Figure 12:
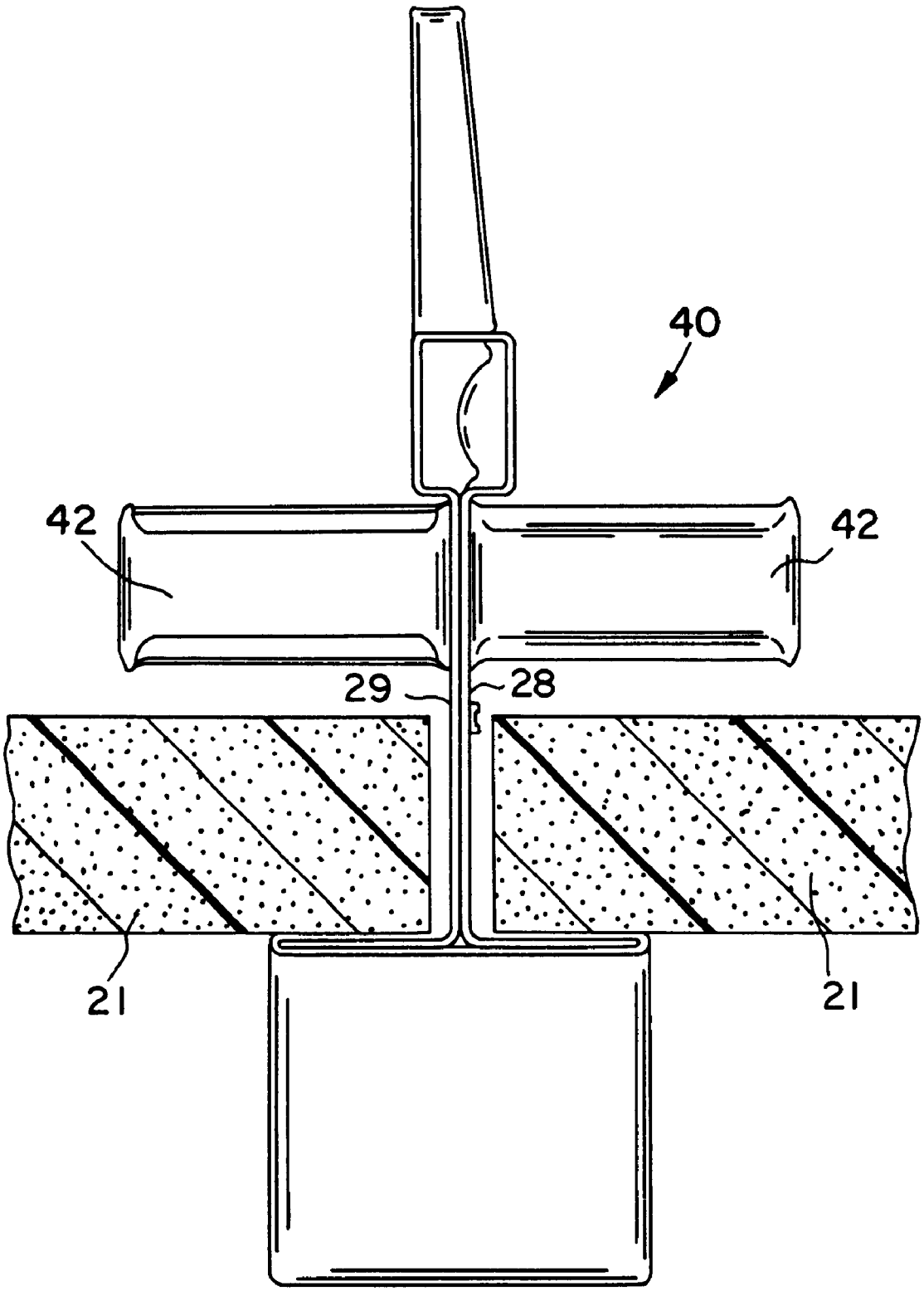
FIG. 12 is a cross-section showing the section fully collapsed.
Figure 13:
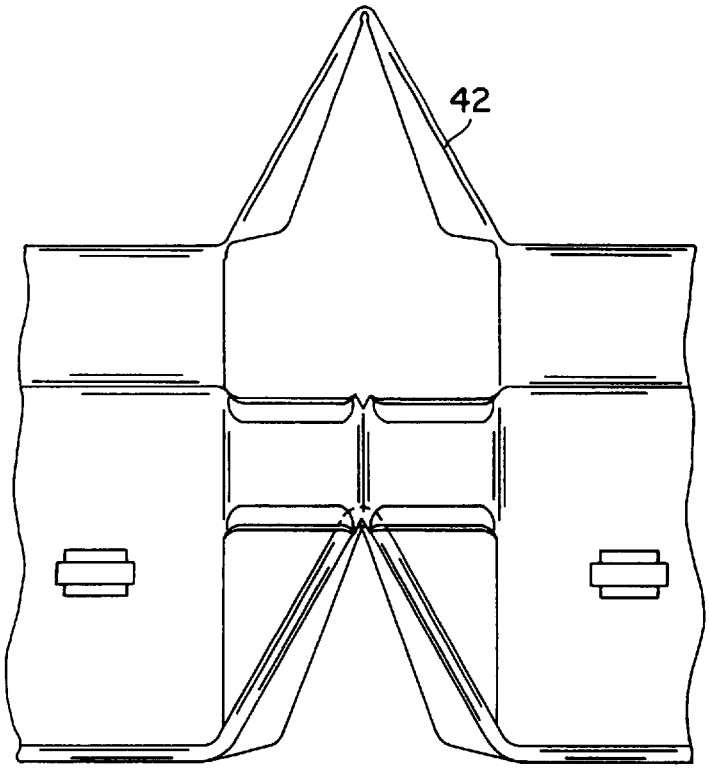
FIG. 13 is a side elevation showing the section partially collapsed, with the bottom flange folding inward.

The length of the cut-out, which is shown as 1.625 inches in FIG. 5, should be such as to provide relief from compressive forces caused by the heat of a fire, when the section fully collapses, as shown in FIGS. 10, 11, and 12. Generally, there is a need to permit the beam to contract 0.1 inch per foot of length of beam in case of fire, so that the dimension shown, 1.625 inches, is enough to relieve a 12 foot section. Alternative dimensions for a cut-out length can be calculated based on the length of beam relieved. It should be understood, however, that the length of the cut-out must permit the section to collapse in the manner shown.

The height of the cut-out is such that it permits the channel to fold outwardly from the web, without interference from the panel. A feature of the invention is that the section maintains structural strength in the grid under normal conditions even though the cut-out in the web is large enough so that the folded channel clears the panel when the section collapses. It is desirable to clear the panel to avoid interference with the panel as the section collapses, and to avoid any displacement of the panel from the folded channel, during the collapse.

Cut-out 41 has at the bottom a web portion 50 having V-shaped corners 45 of a suitable arcuate dimension as shown in FIG. 5. The cut-out then tapers down to virtually the flange at 49 so that there is the least resistance at 49 to the flange folding as set forth below, in the event of a fire.

Channel 42, formed from web 27 by stamping or other suitable operation, is U-shaped in cross-section and has a base 46, and stiffening sides 47. Thus, there is formed from the relatively flexible flat web 27, a channel 42 which is relatively rigid. This is important in providing strength to the section, both under normal conditions, wherein the channel shape compensates for the cut-out of the web, and under fire conditions, where the channel contributes to the controlled collapse and continued strength of the section in a collapsed condition.

A notch 48 is cut into each of the upper and lower sides 47 at the longitudinal center of channel 42 to provide a controlled collapse point when the beam 23 is subject to compressive forces.

Figure 2:
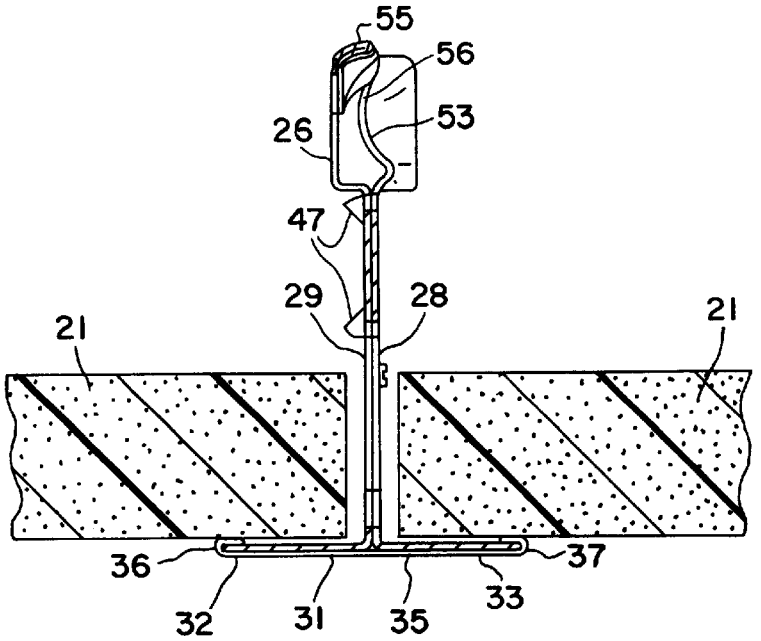
FIG. 2 is an end view taken on line 2.2 of FIG. 1 showing a main beam in cross-section supporting panels on the beam flanges.
Figure 3:
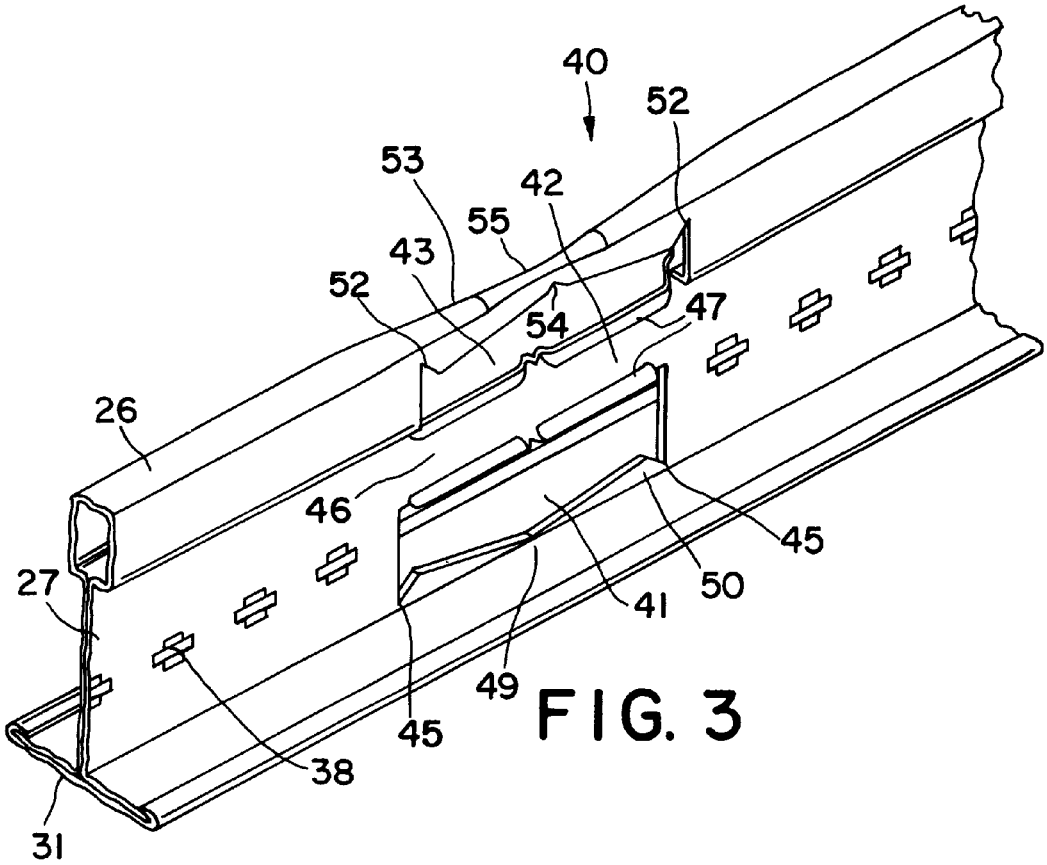
FIG. 3 is a perspective view of a main beam compression relief section.

The sides 47 of channel 42 rise above one side of the base 46. As seen in FIG. 5, for instance, the sides 47 rise toward the viewer. As seen in FIG. 2, the sides 47 rise to the left from the plane of the web 27. A suitable filet 51 is formed at each of the corners of channel 42 that permits the channel to fold under compression, as described below.

Bulb 26 has a cut-out 43 which has a length conforming generally to that of cut-out 41, with a height at the ends 52 that extends substantially into the bulb 26. The amount of metal left in the bulb at the ends 52, however, should be sufficient to provide a contribution to the structural rigidity of the compression relief section 40, so that the section 40 under normal grid conditions has the necessary strength to support panels 21 in the ceiling 20. The arc dimension shown at the ends 52 of the cut-out 43 is illustrative. Such a dimension provides enough rigidity in the bulb 26 under normal grid conditions, while permitting the section 40 to fold under fire conditions, as described below.

The bulb 26 itself is partially crushed at 53 to provide a slightly elevated hump 55. Such hump 55 is formed when one side of bulb 26 is crushed inward as seen particularly in FIG. 2, at 56. An inverted V-shaped notch 54 in the bulb 26 extends below hump 55.

In the event of a fire, main beam 23 heats up, and since the beam is confined at its ends, compression forces build up. These compression forces cause the beam to expand. This expansion is then accommodated within the compression relief section 40 of the invention.

Bulb 26, at hump 55, folds upward; channel 42 folds outward; and flange 31 folds downward.

Figure 4:
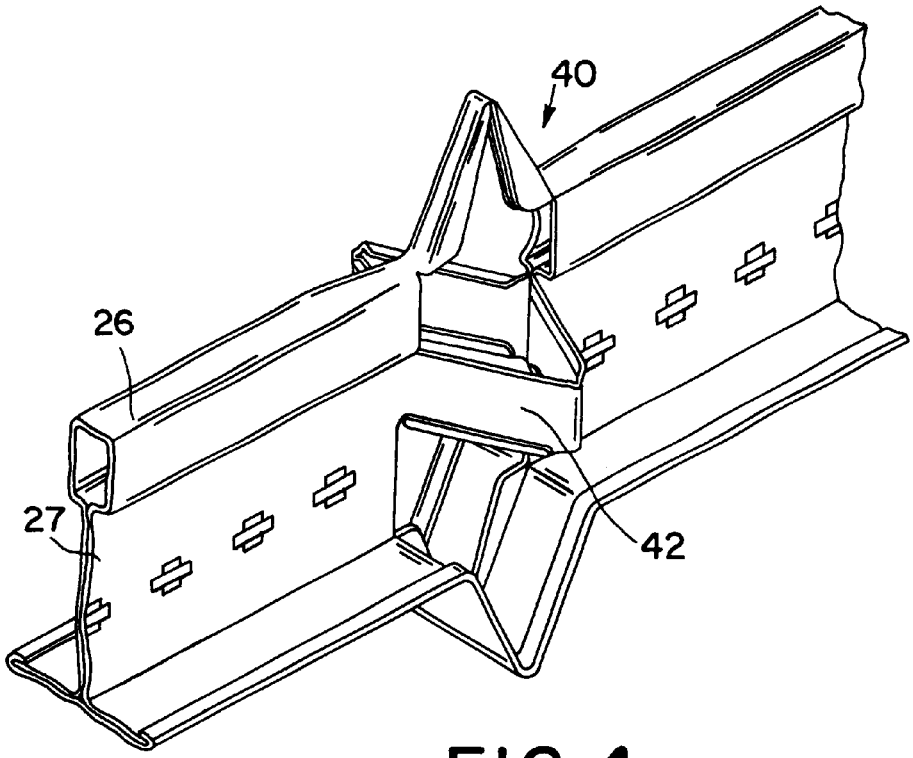
FIG. 4 is a perspective view of the section of FIG. 3 after the section has partially collapsed to relieve compressive forces.
Figure 6:
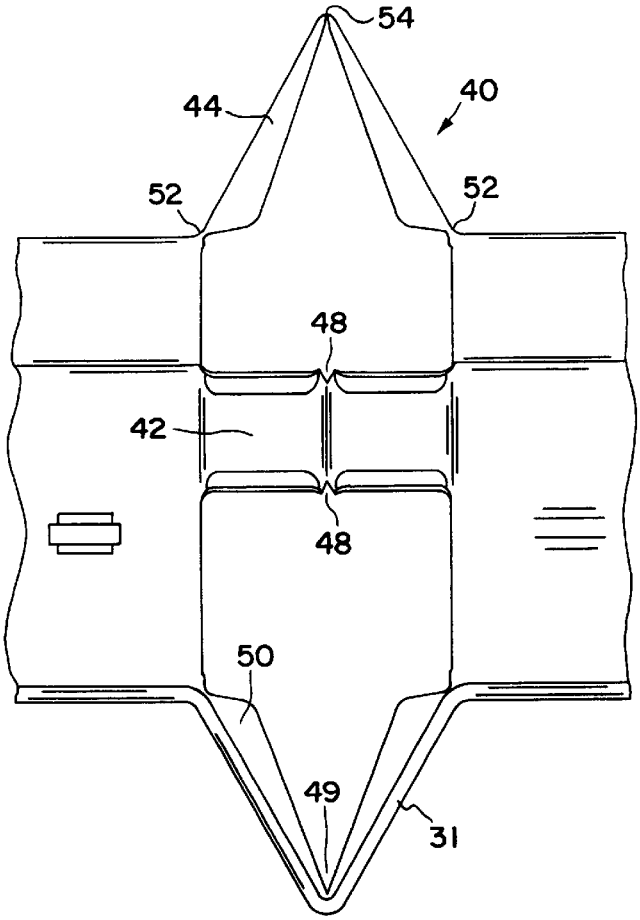
FIG. 6 is a side elevation of the section in partial collapse as shown in FIG. 4.
Figure 7:
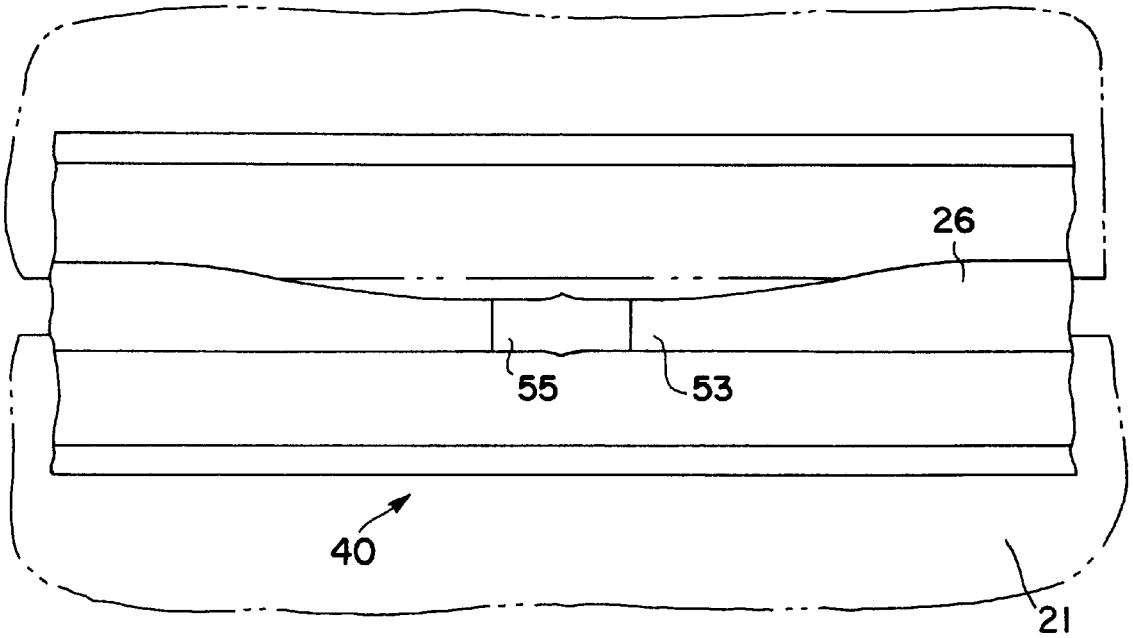
FIG. 7 is a top plan view of the section shown in FIG. 3, supporting panels drawn in phantom.
Figure 8:
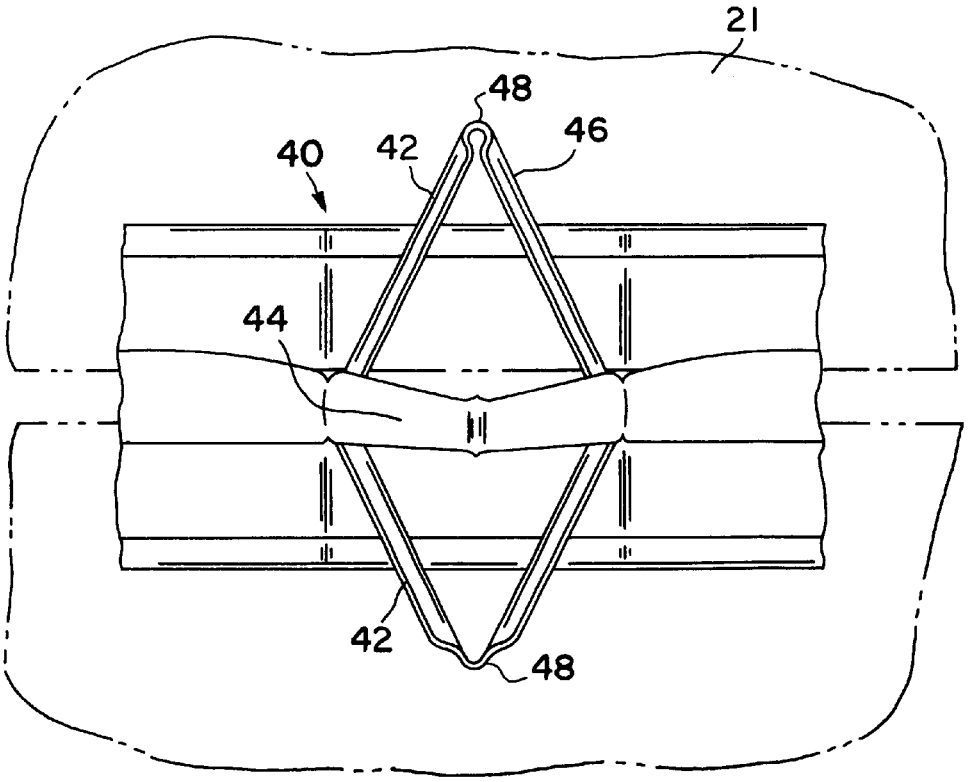
FIG. 8 is a top plan view of the partially collapsed section of FIG. 6, supporting panels as shown in phantom.
Figure 9:
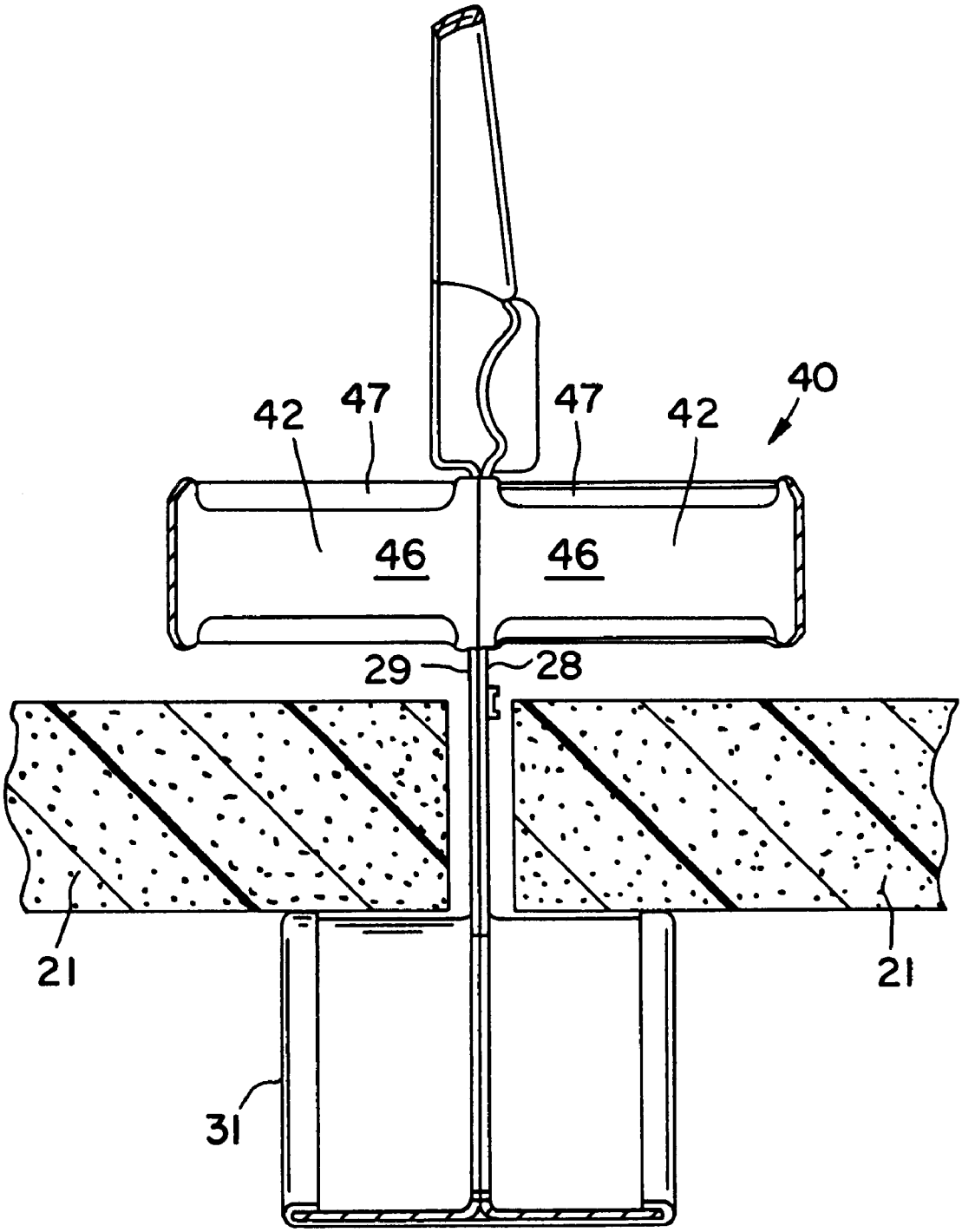
FIG. 9 is a sectional view of a collapsed section, showing the panels the beam continuing to support the panels.

Section 40 is shown partially collapsed in FIGS. 4, 6, and 8, and fully collapsed in FIGS. 9, 10, and 11.

The collapse is a steady one, in which the section 40 offers continued resistance to the compressive forces throughout the collapse.

Throughout the collapse, the beam 23 on both sides of section 40 remains in longitudinal alignment, so that the panels continue to be supported wherein they stay in place to act as a barrier to the fire heat reaching the plenum space above the suspended ceiling.

The channel 42 may fold in a manner wherein each of the layers of the channel extend away from one another, as shown in the drawings, or they may fold in a manner wherein the layers of the channel stay together, wherein the channel fold to one side or the other of the web. The beam stays aligned at the section 40, in any event.

Figure 14:
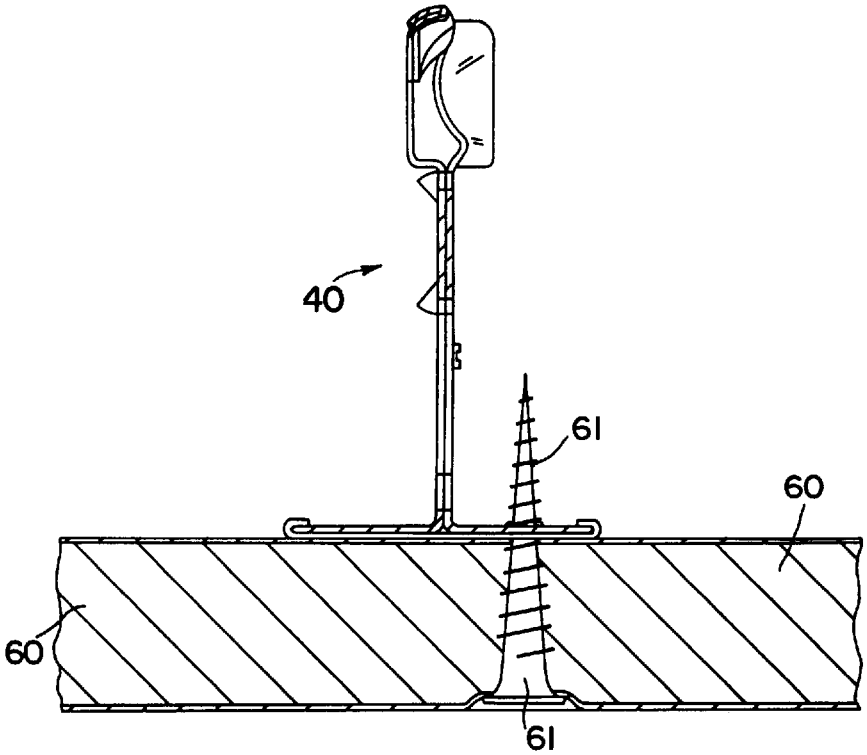
FIG. 14 is a cross-section showing the section being used with dry wall paneling fixed to the beam.

A further use of the invention is in a construction wherein a drywall panel 60 extends over more than one grid opening, and is affixed to the flange of the grid with screws 61 or other fasteners. Such an embodiment is shown in FIG. 14. In such construction, when the section 40 collapses, the flange folds upward into cut-out 41, since the drywall panel resists the downward folding of the flange. The height of the cut-out 41 provides the necessary space for such folding upward of the flange. The shape of the bottom of the cut-out 41 is such that it does not interfere with such upward folding.

What is claimed is:

1. In a beam (23) for a grid (22) that supports panels (21) in a suspended ceiling (20), wherein the beam, in cross section is in the form of an inverted T having a bulb (26) at the top, a vertical web (27), and a flange (31) having sides (32) and (33) extending outwardly from the web, the beam having a compression relief section (40) formed from the web and the bulb, that permits the section to collapse under compressive forces in the beam created during a fire;

the improvement comprising, in the compression relief section,

A) a channel (42)

a) formed from the web;

b) U-shaped in cross sections;

c) having a base (46) and stiffening sides (47) extending from the base; and d) having a notch (48) in the channel forming a controlled collapse point in the channel;

B) a hump (55)

a) formed from the bulb by a crush (56); and b) having a notch (54) forming a controlled collapse point in the bulb; and C) a tapered portion of the web adjacent the flange forming a controlled collapse point in the flange;

wherein all the collapse points are aligned vertically in the beam, whereby, during collapse, the flange folds downwardly, the channel folds outwardly, and the bulb folds upwardly.

2. In a beam (23) for a grid (22) that has dry wall panels (60) attached to the grid, in a suspended ceiling (20), wherein the beam, in cross section is in the form of an inverted T having a bulb (26) at the top, a vertical web (27), and a flange (31) having sides (32) and (33) extending outwardly from the web, the beam having a compression relief section (40) formed from the web and the bulb, that permits the section to collapse under compressive forces in the beam created during a fire;

the improvement comprising, in the compression relief section,

A) a channel (42)

a) formed from the web;

b) U-shaped in cross sections;

c) having a base (46) and stiffening sides (47) extending from the base; and d) having a notch (48) in the channel forming a controlled collapse point in the channel;

B) a hump (55)

a) formed from the bulb by a crush (56); and b) having a notch (54) forming a controlled collapse point in the bulb; and C) a tapered portion of the web adjacent the flange forming a controlled collapse point in the flange;

wherein all the collapse points are aligned vertically in the beam, whereby, during collapse, the flange folds upwardly, the channel folds outwardly, and the bulb folds upwardly.

* * * * *